US006463241B2

(12) United States Patent
Ochiai

(10) Patent No.: US 6,463,241 B2
(45) Date of Patent: Oct. 8, 2002

(54) DEVELOPING APPARATUS HAVING TONER RESTRICTING PORTION FOR RESTRICTING LEAKAGE OF TONER AND AN ELECTRONIC PHOTOGRAPHING APPARATUS HAVING THE DEVELOPING APPARATUS

(75) Inventor: Norikazu Ochiai, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/842,342

(22) Filed: Apr. 25, 2001

(65) Prior Publication Data

US 2001/0038761 A1 Nov. 8, 2001

(30) Foreign Application Priority Data

May 2, 2000 (JP) ..... 2000-133516
Jan. 11, 2001 (JP) ..... 2001-003923

(51) Int. Cl.[7] ..... G03G 15/08

(52) U.S. Cl. ..... 399/252; 399/262

(58) Field of Search ..... 399/111, 119, 399/120, 252, 262, 264, 265, 273, 102; 222/DIG. 1

(56) References Cited

U.S. PATENT DOCUMENTS 5,383,009 A * 1/1995 Tsusaka ..... 399/111
5,771,426 A * 6/1998 Oka et al. ..... 399/119

FOREIGN PATENT DOCUMENTS

JP 8-30099 2/1996
JP 11-174833 7/1999

* cited by examiner

*Primary Examiner*—Sophia S. Chen
*Assistant Examiner*—Hoan Tran
(74) *Attorney, Agent, or Firm*—Frishauf, Holtz, Goodman & Chick, P.C.

(57) ABSTRACT

A developing apparatus is provided which includes a toner container. The toner container has a bottom wall for receiving the toner and an opening facing a photosensitive drum. A toner supplying body is located at the opening. The toner supplying body has a peripheral surface to which the toner is adhered. The toner supplying body is rotated, so that the toner adhered to the peripheral surface is supplied to the photosensitive drum. Toner remaining on the peripheral surface is returned to the toner container through a gap between the toner supplying body and the bottom wall. The toner container has a toner restricting portion projected upward from the bottom wall. The toner restricting portion faces the gap at a position a distance from the gap to be inside the toner container.

16 Claims, 5 Drawing Sheets

DEVELOPING APPARATUS HAVING TONER RESTRICTING PORTION FOR RESTRICTING LEAKAGE OF TONER AND AN ELECTRONIC PHOTOGRAPHING APPARATUS HAVING THE DEVELOPING APPARATUS

CROSS-REFERENCE TO RELATED APPLICATIONS

This application is based upon and claims the benefit of priority from the prior Japanese Patent Applications No. 2000-133516, filed May 2, 2000; and No. 2001-003923, filed Jan. 11, 2001, the entire contents of both of which are incorporated herein by reference.

BACKGROUND OF THE INVENTION

The present invention relates to a developing apparatus having a toner container for storing toner and a developing roller incorporated in the toner container, and to an electronic photographing apparatus, such as a laser printer or a copying machine, incorporating the developing apparatus. More specifically, the present invention relates to a structure for preventing toner from spilling from the toner container, when the toner pressure in the toner container is increased.

An electronic photographing apparatus, such as a laser printer, comprises a photosensitive drum having a surface on which an electrostatic latent image is formed, a developing apparatus for developing the electrostatic latent image to a toner image, and a transferring apparatus for transferring the toner image to a recording paper sheet.

The developing apparatus for use in this type of electronic photographing apparatus has a toner container for storing toner. The toner container has an opening portion, which faces the photosensitive drum. A developing roller and a developing plate are located in the opening portion. The developing roller is arranged parallel to the photosensitive drum. The developing roller incorporates a magnet roller. Owing to the magnetic force of the magnet roller, toner is attracted to the peripheral surface of the developing roller. As the developing roller rotates, the toner adhered to the peripheral surface of the developing roller is guided to a developing position between the developing roller and the photosensitive drum.

The function of the developing plate is to make a toner layer adhered to the peripheral surface of the developing roller uniform in thickness. The developing plate is arranged at a position opposite from the developing position in the direction of rotation of the developing roller.

With the developing apparatus described above, the toner adhered to the peripheral surface of the developing roller is first guided to the developing plate as the developing roller rotates, and excess toner is scraped off by the plate. As a result, a thin uniform toner layer is formed on the peripheral surface of the developing roller. The toner layer is guided to the developing position by the rotation of the developing roller, and adhered to the surface of the photosensitive drum at this position. Consequently, the electrostatic latent image on the surface of the photosensitive drum is developed, so that a toner image is formed on the surface.

In the conventional developing apparatus, the toner container has a bottom wall for receiving toner. The bottom wall has an end portion facing the opening portion. The end portion of the bottom wall is located under the developing roller and faces the peripheral surface of the developing roller. A gap is provided between the end portion of the bottom wall and the peripheral surface of the developing roller for the following reason.

Even after the toner passes through the developing position, part of the toner is kept attracted to the peripheral surface of the developing roller and remains on the surface. The remaining toner is returned to the opening portion of the toner container as the developing roller rotates.

At this time, if there is no gap between the developing roller and the bottom wall of the toner container, the toner remaining on the developing roller is brought into contact with the bottom wall at the opening portion, and removed from the peripheral surface of the developing roller. The removed toner is accumulated in the end portion of the bottom wall and cannot be returned into the toner container. Therefore, the amount of toner accumulated in the end portion of the bottom wall is increased with the passage of time, resulting in the drawback that the toner is scattered out of the toner container through the opening portion.

For the reason described above, according to the conventional developing apparatus, a gap is positively provided between the bottom wall of the toner container and the developing roller to avoid contact between the toner remaining on the peripheral surface of the developing roller and the bottom wall, thereby preventing scattering of the toner.

In the case where there is a gap between the bottom wall of the toner container and the developing roller, it is inevitable that part of the toner contained in the toner container will enter the gap. The toner in the gap is influenced by the magnetic force of the magnet roller and attracted to the peripheral surface of the developing roller in a normal image forming operation. Therefore, the toner in the gap is never scattered or spilt out of the toner container.

However, if the developing apparatus receives shock, for example, when the developing apparatus is set to the electronic photographing apparatus, the pressure of the toner contained in the toner container may be temporarily increased. This pressure may be exerted on the gap. Further, when the toner container is replenished with new toner, the new toner put in the toner container drops on the existing toner. Therefore, this shock may increase the pressure of the toner in the toner container. This pressure may be exerted on the gap.

In this case, the toner attracted to the peripheral surface of the developing roller at the position of the gap or the toner located near the gap may be pushed out from the toner container. This results in the problems that the toner is scattered around the toner container, contaminates the interior of the electronic photographing apparatus or adheres to recording paper.

BRIEF SUMMARY OF THE INVENTION

An object of the present invention is to provide a developing apparatus and an electronic photographing apparatus, in which although there is a gap between a toner supplying body and a bottom wall of a toner container, toner is prevented from spilling out through the gap.

To achieve the above object, a developing apparatus according to a first aspect of the present invention comprises: a toner container for storing toner, the toner container having a bottom wall for receiving the toner and an opening formed at an end portion of the bottom wall and facing a photosensitive body on which an electrostatic latent image is formed; a toner supplying body located at the opening of the toner container, the toner supplying body having a peripheral surface which is exposed in the toner container and to which the toner is adhered, for supplying the toner adhered to the peripheral surface to the photosensitive body by rotation, a gap being formed between the peripheral surface and the bottom wall to return toner remaining on the peripheral surface of the toner supplying body to the toner container; and a toner restricting portion projected upward from the bottom wall of the toner container, the toner restricting portion facing the gap at a position a distance from the gap to be inside the toner container.

In the above structure, if the toner container receives a shock or is replenished with new toner, the pressure of the toner in the toner container is increased. Due to the increase in pressure, the toner near the gap is liable to be pressed out through the gap. However, since the toner restricting portion faces the gap in the toner container, it can receive, immediately upstream from the gap, the pressure of the toner which is exerted toward the gap.

Therefore, the toner held by the toner supplying body and facing the gap or the toner existing near the gap is not pressed out of the toner container. Thus, the toner can be prevented from scattering out of the toner container.

To achieve the above object, a developing apparatus according to a second aspect of the present invention comprises: a toner container for storing toner, the toner container having a bottom wall for receiving the toner and an opening formed at an end portion of the bottom wall and facing a photosensitive body on which an electrostatic latent image is formed; a toner supplying body located at the opening of the toner container, the toner supplying body having a peripheral surface which is exposed in the toner container and to which the toner is adhered, for supplying the toner adhered to the peripheral surface to the photosensitive body by rotation, a gap being formed between the peripheral surface and the bottom wall to return toner remaining on the peripheral surface of the toner supplying body to the toner container; and a toner restricting portion projected upward from the bottom wall of the toner container, the toner restricting portion facing the gap at a position a distance from the gap to a side of the photosensitive body.

In the above structure, if the toner container receives a shock or is replenished with new toner, the pressure of the toner in the toner container is increased. Due to the increase in pressure, the toner near the gap is liable to be pressed out through the gap. However, since the toner restricting portion faces the gap from the side of the photosensitive body, even if the toner flows into the gap, the flow of the toner is blocked at the position of the toner restricting portion.

Therefore, the toner held by the toner supplying body and facing the gap or the toner existing near the gap is not pressed out of the toner container. Thus, the toner can be prevented from scattering out of the toner container.

To achieve the above object, a developing apparatus according to a third aspect of the present invention comprises: a toner container for storing toner, the toner container having a bottom wall for receiving the toner and an opening formed at an end portion of the bottom wall and facing a photosensitive body on which an electrostatic latent image is formed; a toner supplying body located at the opening of the toner container, the toner supplying body having a peripheral surface which is exposed in the toner container and to which the toner is adhered, for supplying the toner adhered to the peripheral surface to the photosensitive body by rotation, a gap being formed between the peripheral surface and the bottom wall to return toner remaining on the peripheral surface of the toner supplying body to the toner container; and first and second toner restricting portions projected upward from the bottom wall of the toner container and facing the gap with the toner supplying body interposed therebetween.

In the above structure, if the toner container receives a shock or is replenished with new toner, the pressure of the toner in the toner container is increased. Due to the increase in pressure, the toner near the gap is liable to be pressed out through the gap. However, since one of the first and second toner restricting portions faces the gap in the toner container, it can receive, immediately upstream from the gap, the pressure of the toner that is exerted toward the gap. As a result, increase in pressure near the gap can be prevented. Since the other toner restricting portion faces the gap from the side of the photosensitive body, even if the toner flows into the gap, the flow of the toner is blocked at the position of the other toner restricting portion.

Therefore, when the toner held by the toner supplying body and facing the gap or the toner existing near the gap is liable to be pressed out of the toner container, it can be blocked by the two toner restricting portions provided on both sides of the toner supplying body. Thus, it is particularly ensured that the toner is prevented from scattering out of the toner container.

To achieve the above object, an image processing unit of the present invention comprises: a photosensitive body on which an electrostatic latent image is formed; and a developing apparatus to be brought into combination with the photosensitive body. The developing apparatus comprises: a toner container for storing toner, the toner container having a bottom wall for receiving the toner and an opening formed at an end portion of the bottom wall and facing the photosensitive body; a toner supplying body located at the opening of the toner container, the toner supplying body having a peripheral surface which is exposed in the toner container and to which the toner is adhered, for supplying the toner adhered to the peripheral surface to the photosensitive body by rotation, a gap being formed between the peripheral surface and the bottom wall to return toner remaining on the peripheral surface of the toner supplying body to the toner container; and at least one toner restricting portion projected upward from the bottom wall of the toner container, the toner restricting portion facing the gap at one of a position a distance from the gap to be inside the toner container and a position a distance from the gap to a side of the photosensitive body.

Further, to achieve the above object, an electronic photographing apparatus comprises: an apparatus body having a transfer path through which a sheet-like recording medium is transferred; a photosensitive body which is arranged in the transfer path and on which an electrostatic latent image is formed; and a developing apparatus for causing toner adhered to the electrostatic latent image, thereby forming a toner image. The developing apparatus comprises: a toner container for storing the toner, the toner container having a bottom wall for receiving the toner and an opening formed at an end portion of the bottom wall and facing the photosensitive body; a toner supplying body located at the opening of the toner container, the toner supplying body having a peripheral surface which is exposed in the toner container and to which the toner is adhered, for supplying the toner adhered to the peripheral surface to the photosensitive body by rotation, a gap being formed between the peripheral surface and the bottom wall to return toner remaining on the peripheral surface of the toner supplying body to the toner container; and at least one toner restricting portion projected upward from the bottom wall of the toner container, the toner restricting portion facing the gap at one of a position a distance from the gap to be inside the toner container and a position a distance from the gap to a side of the photosensitive body.

In the above structure, if the toner container receives a shock or is replenished with new toner, the pressure of the toner in the toner container is increased. Due to the increase in pressure, the toner near the gap is liable to be pressed out through the gap.

However, if the toner restricting portion is provided at the position facing the gap in the toner container, it can receive, immediately upstream from the gap, the pressure of the toner that is exerted toward the gap. As a result, increase in pressure near the gap can be prevented. If the toner restricting portion is provided at the position facing the gap from the side of the photosensitive body, even if the toner flows into the gap, the flow of the toner is blocked at the position of the toner restricting portion. Further, if the two toner restricting portions are provided at both the position facing the gap in the toner container and the position facing the gap from the side of the photosensitive body, when the toner is liable to be pressed out of the toner container, it can be blocked by the two toner restricting portions provided on both sides of the toner supplying body.

Thus, the toner is prevented from scattering out of the toner container, and the problem of contamination of the photosensitive body, the apparatus body or the recording medium can be solved.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

A first embodiment of the present invention, applied to an electronic photographing apparatus, will be described with reference to FIGS. 1 to 4.

Figure 1:
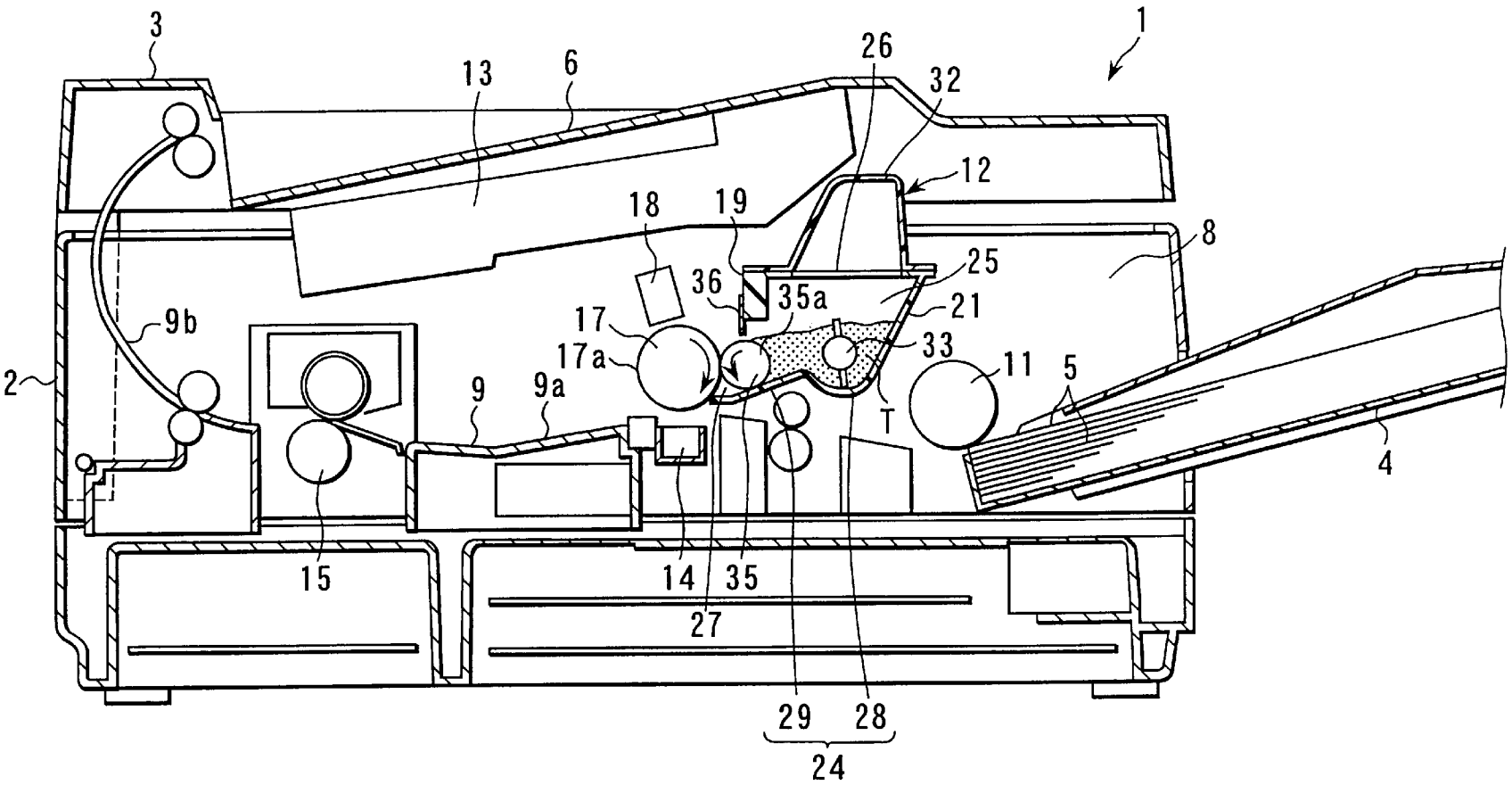
FIG. 1 is a cross-sectional view schematically showing a structure of an electronic photographing apparatus according to a first embodiment of the present invention.

FIG. 1 schematically shows the overall structure of an electronic photographing apparatus 1. The electronic photographing apparatus 1 comprises an apparatus body 2 and a top cover 3. The apparatus body 2 has a paper feed cassette 4 on one side portion thereof. Recording paper sheets 5, serving as a recording media, are stacked in the paper feed cassette 4. The top cover 3 is rotatably supported by the apparatus body 2 between a first position (shown in FIG. 1) at which the top cover 3 fits to the top of the apparatus body 2 and a second position (shown in FIG. 2) at which it is apart from the apparatus body 2. The top cover 3 has a stacker table 6 for receiving recording paper sheets 5.

The apparatus body 2 comprises a device accommodating chamber 8. The device accommodating chamber 8 opens at a top end of the apparatus body 2, and is opened and closed by the top cover 3. Therefore, when the top cover 3 is rotated from the first position to the second position, the device accommodating chamber 8 is opened upward on top of the apparatus body 2.

The device accommodating chamber 8 includes a transfer path 9. The transfer path 9, for transferring the recording paper sheet 5 from the paper feed cassette 4 to the stacker table 6, comprises a plurality of rollers and guide plates. The transfer path 9 has a first-half portion 9*a* connected to the paper feed cassette 4 and a second-half portion 9*b* connected to the stacker table 6. The first-half portion 9*a* extends horizontally in the device accommodating chamber 8. The second-half portion 9*b* extends up toward the stacker table 6 from the termination of the first-half portion 9*a*.

Figure 2:
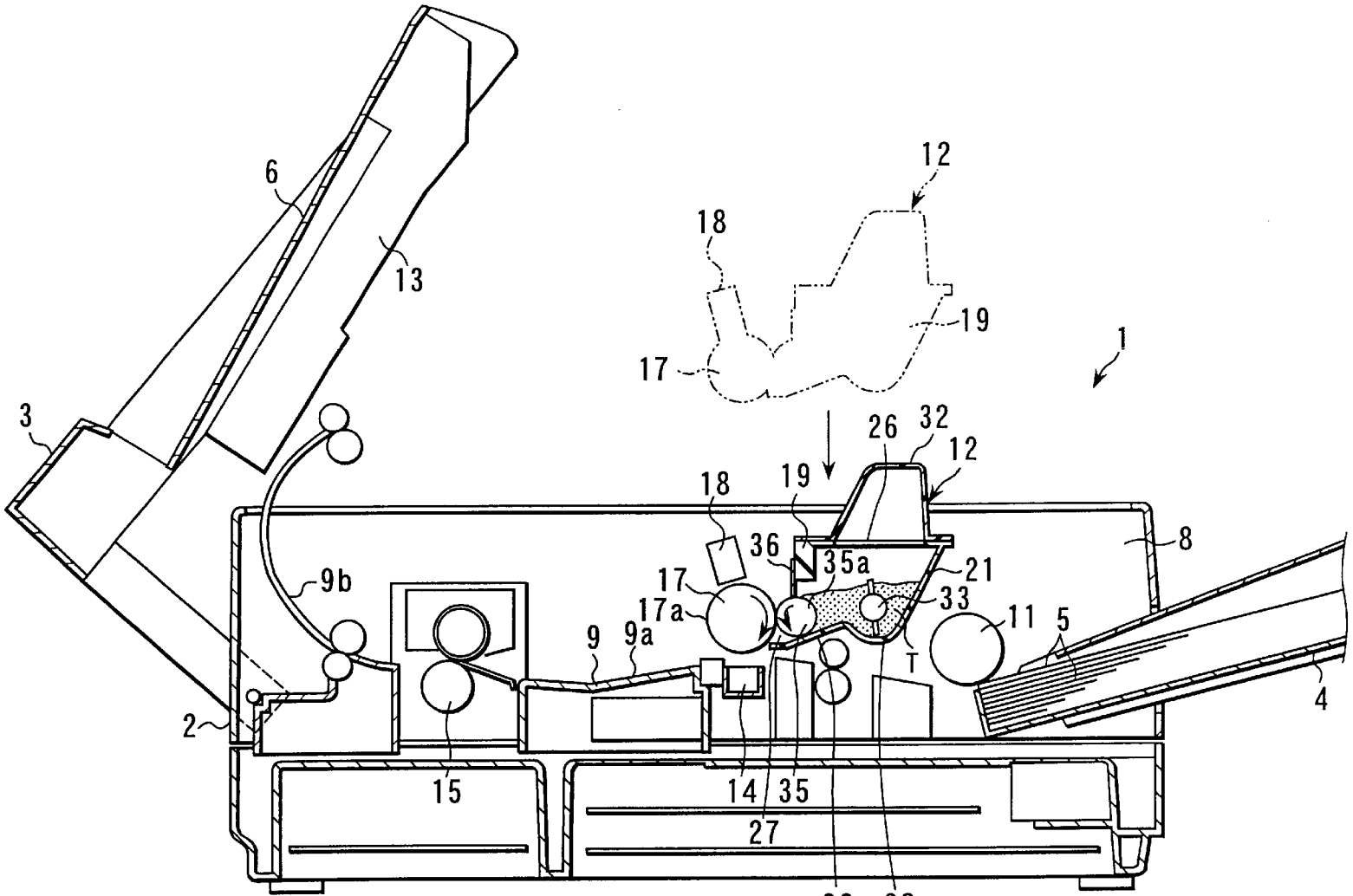
FIG. 2 is a cross sectional view of the electronic photographing apparatus according to the first embodiment of the present invention showing a state in which a top cover of the apparatus is opened to expose an image processing unit incorporated in the apparatus body.

As shown in FIGS. 1 and 2, the device accommodating chamber 8 accommodates a paper feed roller 11, an image processing unit 12, an exposing apparatus 13, a transferring apparatus 14 and a fixing apparatus 15.

The paper feed roller 11 feeds recording paper sheets 5, stacked in the paper feed cassette 4, one by one to the transfer path 9. It is located at the beginning of the first-half portion 9*a*. The image processing unit 12 is located above the first-half portion 9*a* of the transfer path 9, and detachably supported by the apparatus body 2 in an upper portion of the device accommodating chamber 8.

The image processing unit 12 comprises a photosensitive drum 17, a charging apparatus 18 and a developing apparatus 19. The photosensitive drum 17, having a cylindrical surface 17*a* on which an electrostatic latent image is formed, is arranged horizontally along a direction perpendicular to the direction in which the recording paper sheet 5 is transferred. The photosensitive drum 17 is rotated clockwise as indicated by the arrows in FIGS. 1 and 4. The charging apparatus 18, for charging the surface 17*a* of the photosensitive drum 17, is located above the photosensitive drum 17. The developing apparatus 19 develops the electrostatic latent image formed on the surface 17*a* of the photosensitive drum 17 to form a toner image. The developing apparatus 19 and the photosensitive drum 17 are detachably connected.

The exposing apparatus 13 radiates an optical signal corresponding to an image signal to the surface 17*a* of the photosensitive drum 17, thereby forming an electrostatic latent image on the surface 17*a*. The exposing apparatus 13, supported by the top cover 3, is located above the image processing unit 12.

The transferring apparatus 14 transfers the toner image formed on the surface 17*a* of the photosensitive drum 17 to the recording paper sheet 5. The transferring apparatus 14 faces the photosensitive drum 17 with the transfer path 9 interposed therebetween. The fixing apparatus 15, for fixing the toner image transferred to the recording paper sheet 5, is located at the termination of the first-half portion 9*a* of the transfer path 9.

Figure 3:
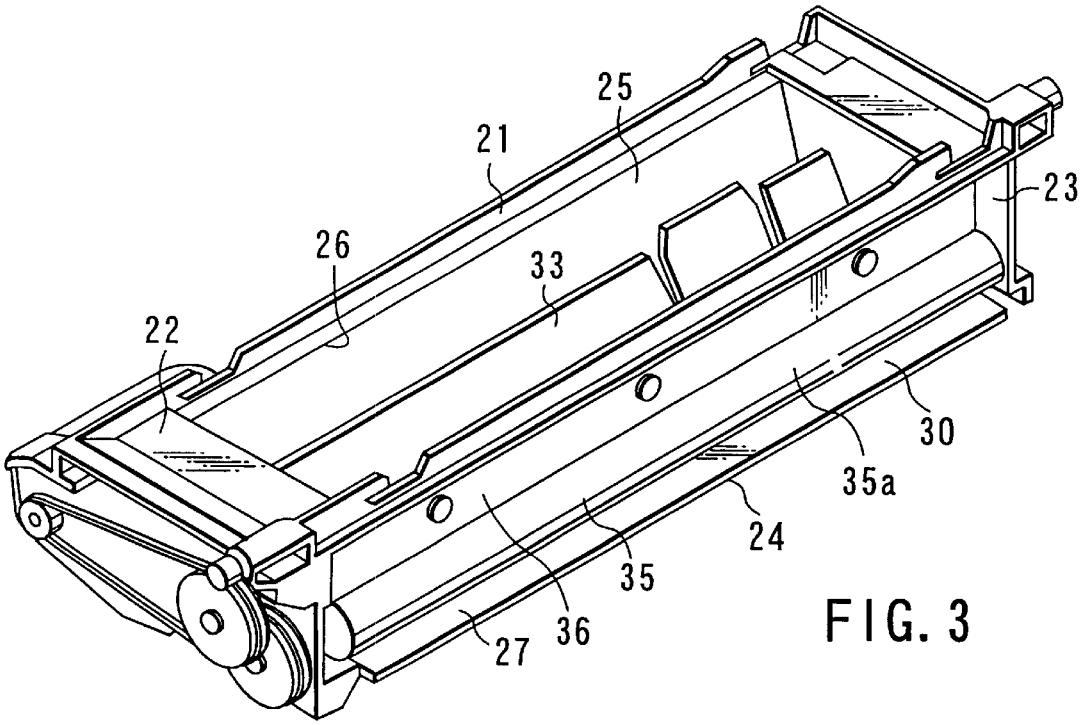
FIG. 3 is a perspective view of a toner container showing a positional relationship between a developing roller and a bottom wall according to the first embodiment of the present invention.
Figure 4:
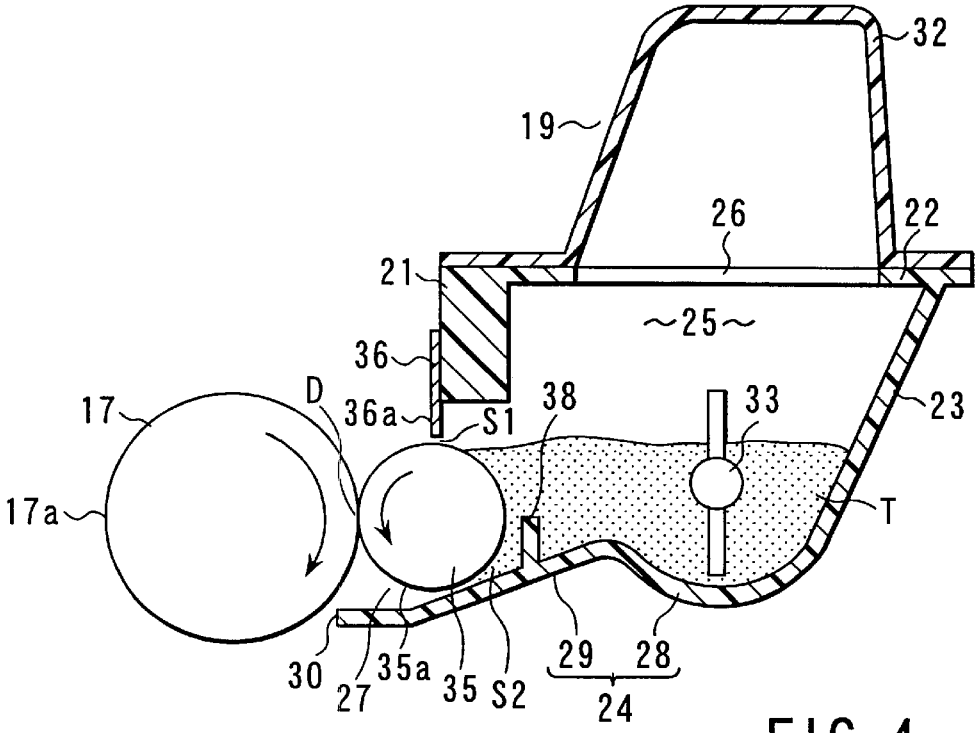
FIG. 4 is a cross-sectional view of a developing apparatus according to the first embodiment of the present invention.

The developing apparatus 19 for developing the electrostatic latent image comprises a toner container 21 as shown in FIGS. 3 and 4. The toner container 21 is arranged parallel to the photosensitive drum 17 and shaped as a box extending in the axial direction of the photosensitive drum 17. The toner container 21 has an upper wall 22, a peripheral wall 23 and a bottom wall 24. These walls 22 to 24 constitute a toner storing chamber 25 for storing magnetic toner T in the toner container 21.

The upper wall 22 of the toner container 21 has a toner supply port 26. The peripheral wall 23 of the toner container 21 has an opening 27, which faces the photosensitive drum 17. The toner supply port 26 and the opening 27, each having a long and narrow shape extending in the longitudinal direction of the toner container 21, communicate with the toner storing chamber 25. The bottom wall 24 of the toner container 21 is opposite to the toner supply port 26, so that it can receive the toner T introduced through the toner supply port 26. The bottom wall 24 comprises a curved portion 28 and an inclined portion 29. The curved portion 28 is curved downward so as to expand in the bottom portion of the toner container 21. The inclined portion 29 is inclined downward from an end of the curved portion 28 toward the opening 27. The top end of the inclined portion 29 faces the opening 27. An extension portion 30 extends horizontally from the top end of the inclined portion 29 toward the photosensitive drum 17.

A toner cartridge 32 is arranged above the toner container 21. The toner cartridge 32, for replenishing the toner container 21 with the toner T through the toner supply port 26, is removably supported by the upper wall 22 of the toner container 21. The toner storing chamber 25 contains a mixer 33 for mixing the toner T. The mixer 33 is located between the curved portion 28 and the toner supply port 26.

A developing roller 35, serving as a toner supplying body, is arranged in the opening 27. The developing roller 35 is equal in length to the photosensitive drum 17 and arranged parallel to the photosensitive drum 17. The developing roller 35 has a cylindrical peripheral surface 35*a*. A half, in the circumferential direction, of the peripheral surface 35*a* of the developing roller 35*a* is exposed to the toner storing chamber 25. The developing roller 35 incorporates a magnet roller (not shown). Therefore, the toner T is attracted to the peripheral surface 35*a* of the developing roller 35 by the magnetic force of the magnet roller.

As indicated by the arrows in FIGS. 1 and 4, the developing roller 35 is rotated counterclockwise, i.e., in the direction opposite to that of rotation of the photosensitive drum 17. Therefore, the peripheral surface 35*a* of the developing roller 35 is moved from the upper edge to the lower edge of the opening 27. The peripheral surface 35*a* of the developing roller 35 faces the surface 17*a* of the photosensitive drum 17. The peripheral surface 35*a* of the developing roller 35 and the surface 17*a* of the photosensitive drum 17 get closest to each other at a developing position D, where the electrostatic latent image on the surface 17*a* of the photosensitive drum 17 is developed.

A developing plate 36 is supported by the toner container 21. The developing plate 36 scrapes off an excess of the toner T adhered to the peripheral surface 35*a* of the developing roller 35, in order to make a thin toner layer of a uniform thickness on the peripheral surface 35*a*. The developing plate 36 is located parallel to the developing roller 35 above the developing roller 35. The lower end 36*a* of the developing plate 36 faces the peripheral surface 35*a* of the developing roller 35. There is a gap S1, corresponding to the thickness of the toner layer, between the developing plate 36 and the developing roller 35.

As shown best in FIG. 4, the developing roller 35 is located above the inclined portion 29 and the extension portion 30 of the bottom wall 24. Since the inclined portion 29 is inclined downward toward the end of the opening 27, the toner T existing on the inclined portion 29 naturally flows toward the opening 27 due to the influence of gravity. Thus, the toner T is positively supplied to the peripheral surface 35*a* of the developing roller 35.

The peripheral surface 35*a* of the developing roller 35 is closest to the inclined portion 29 of the bottom wall 24. There is a gap S2 between the peripheral surface 35*a* of the developing roller 35 and the inclined portion 29. The gap S2 is formed in order to collect the toner T remaining on the peripheral surface 35*a* of the developing roller 35 in the toner storing chamber 25. The gap S2 extends in the axial direction of the developing roller 35 and communicates with the toner storing chamber 25. The gap S2 is set to a width of, for example, 0.85 mm.

The bottom wall 24 of the toner container 21 has a toner restricting portion 38. The toner restricting portion 38 is a wall erected vertically on the inclined portion 29 and extending parallel to the axial direction of the developing roller 35. The toner restricting portion 38 faces the gap S2 at a position a little distance from the developing roller 35 to be inside the toner container 21.

The toner restricting portion 38, for restricting an action of the pressure of the toner T in the toner storing chamber 25 on the gap S2, is formed integrally with the bottom wall 24 as one piece. The toner restricting portion 38 directly faces the gap S2 with no other element interposed between the peripheral surface 35*a* of the developing roller 35 and the toner restricting portion 38. It is located in proximity to the peripheral surface 35*a* of the developing roller 35 and the gap S2. The height of the toner restricting portion 38 and the relative position thereof with respect to the developing roller 35 are set so as not to inhibit the toner T remaining on the peripheral surface 35*a* of the developing roller 35 in the gap S2 from returning to the toner storing chamber 25.

In the electronic photographing apparatus 1 having the above structure, the surface 17*a* of the photosensitive drum 17 is charged by the charging apparatus 18 while the photosensitive drum 17 is rotating. As a result, an electrostatic latent image is formed on the charged portion of the surface 17*a* by the exposing apparatus 13. The electrostatic latent image is developed by the toner T supplied from the developing apparatus 19.

The developing roller 35 of the developing apparatus 19 is located in the opening 27 of the toner container 21, and a half of the peripheral surface 35*a* faces the toner storing chamber 25. Therefore, as the developing roller 35 rotates, the toner T is attracted to the peripheral surface 35*a* of the developing roller 35 by the magnetic force of the incorporated magnet roller.

The toner T adhered to the peripheral surface 35*a* of the developing roller 35 is guided to the developing plate 36 as the developing roller 35 rotates, and excess toner is scraped off while it is passing through the developing plate 36. As a result, a thin uniform toner layer is formed on the peripheral surface 35*a* of the developing roller 35.

The toner layer is guided to the developing position D by the rotation of the developing roller 35, and adhered to the surface 17*a* of the photosensitive drum 17 at the developing position D. Consequently, the electrostatic latent image on the surface 17*a* of the photosensitive drum 17 is developed, so that a toner image is formed on the surface 17*a*.

Even after the toner T passes through the developing position D, part of the toner T is kept attracted to the peripheral surface 35*a* of the developing roller 35 and remains on the surface 35*a*. The toner T remaining on the peripheral surface 35*a* is returned to the toner storing chamber 25 from the opening 27 through the gap S2 as the developing roller 35 rotates.

Since the gap S2 communicates with the toner storing chamber 25, part of the toner T stored in the toner storing chamber 25 enters the gap S2. In a normal image forming operation, the toner T in the gap S2 is attracted to the peripheral surface 35*a* of the developing roller 35 by the magnetic force of the magnet roller. Therefore, the toner T in the gap S2 never flows out of the toner container 21 through the opening 27.

However, if the toner T stored in the toner storing chamber 25 receives shock when the image processing unit 12 is set into the device accommodating chamber 8 or when the toner storing chamber 25 is replenished with new toner through the toner supply port 26, the pressure of the toner T in the toner storing chamber 25 may be increased. This pressure may be exerted on the gap S2.

With the structure of the above embodiment, the toner restricting portion 38 faces the gap S2 at a position a little distance from the developing roller 35 to be inside of the toner container 21. Therefore, the toner restricting portion 38 can receive the pressure of the toner T flowing toward the gap S2 and the toner T rushed toward the gap S2 by the increase of the pressure immediately upstream from the gap S2.

For this reason, the toner T remaining on the peripheral surface 35*a* of the developing roller 35 and facing the gap S2 and the toner T located near the gap S2 are not pressed out of the toner container 21. Therefore, in spite of the gap S2 for collecting the toner T formed between the developing roller 35 and the bottom wall 24, the toner T is inhibited from scattering out of the toner container 21, thereby preventing the transfer path 9, the photosensitive drum 17 or the recording paper sheet 5 from contamination.

In addition, since the toner restricting portion 38 is formed in the inclined portion 29 inclined downward toward the developing roller 35, the toner T flowing toward the developing roller 35 by the influence of gravity is stopped immediately upstream from the gap S2. Therefore, although the toner container 21 has the structure for positively introducing the toner T along the inclined portion 29 to the peripheral surface 35*a* of the developing roller 35, the toner T does not rush into the gap S2. Consequently, it is particularly ensured that the toner T is prevented from scattering out through the gap S2.

Further, since the toner restricting portion 38 is located near the developing roller 35 at a position such that the toner T is not prevented from returning to the toner storing chamber 25, it is ensured that the pressure of the toner T is received by the toner restricting portion 38 immediately upstream from the gap S2.

Furthermore, since the toner restricting portion 38 directly faces the gap S2 with no other member interposed therebetween, accumulation of the toner due to another member is prevented. If there is another member between the toner restricting member 38 and the gap S2, the toner T may be introduced to the gap S2 via the member. In this case, the pressure in the gap S2 may be increased contrary to the purpose of the toner restricting member 38. However, according to the present invention, since the toner restricting portion 38 directly faces the gap S2, even if the pressure in the toner storing chamber 25 is increased, it can be ensured that the movement of the toner T toward the gap S2 is restricted.

Figure 5:
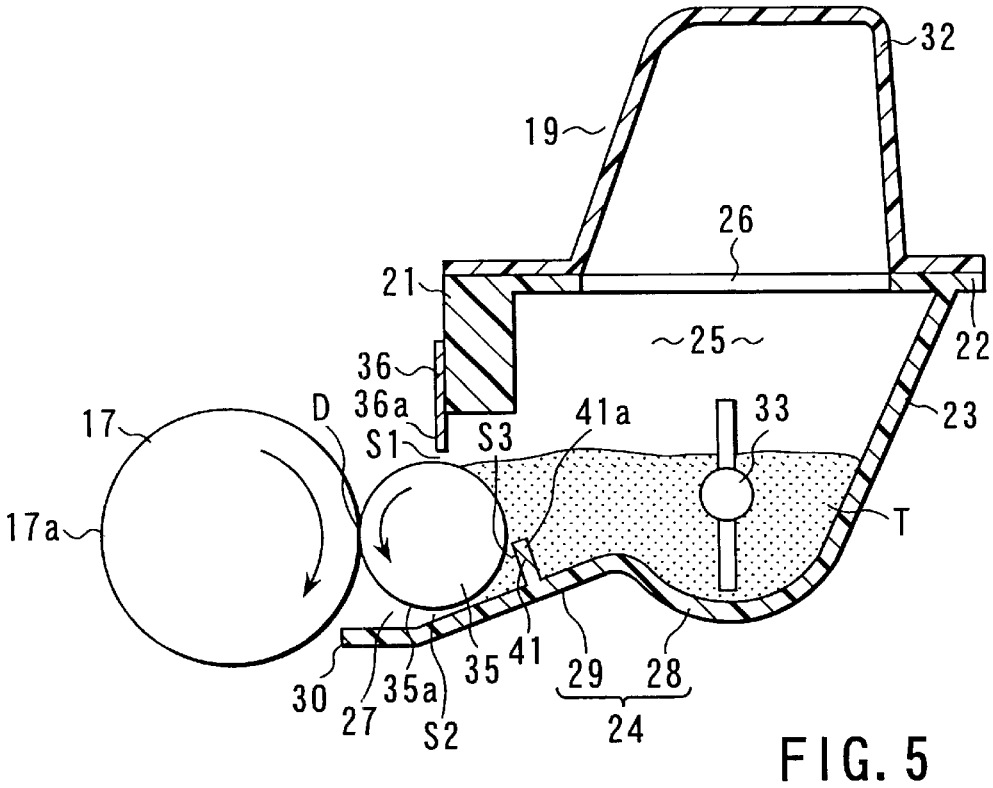
FIG. 5 is a cross-sectional view of a developing apparatus according to a second embodiment of the present invention.

The present invention is not limited to the first embodiment described above. FIG. 5 shows a second embodiment of the present invention. The second embodiment is different from the first embodiment only in a toner restricting portion 41. All the structures of the developing apparatus 19 of the second embodiment, except the toner restricting portion, are the same as those of the first embodiment.

As shown in FIG. 5, the toner restricting portion 41 is projected upward from the inclined portion 29 of the bottom wall 24. The toner restricting portion 41 directly faces the gap S2 within the toner container 21 and is inclined with respect to the vertical line toward the peripheral surface 35*a* of the developing roller 35. Therefore, the toner restricting portion 41 extends toward the peripheral surface 35*a* of the developing roller 35 immediately upstream from the gap S2. There is a gap S3 between the top end 41*a* of the toner restricting portion 41 and the peripheral surface 35*a* of the developing roller 35. The gap S3 has such a width that does not prevent the toner T from returning to the toner storing chamber 25.

With this structure, since the toner restricting portion 41 is projected upward from the inclined portion 29 of the bottom wall 24, it can receive the pressure of the toner T flowing toward the gap S2 and the toner T rushed toward the gap S2 by the increase of the pressure immediately upstream from the gap S2. Therefore, as in the case of the first embodiment, the toner restricting portion 41 restricts the movement of the toner T toward the gap S2, thereby preventing the toner T from scattering out of the toner container 21.

Moreover, since the toner restricting portion 41 is inclined toward the developing roller 35, the toner received by the toner restricting portion 41 can be guided toward the peripheral surface 35*a* of the developing roller 35. Thus, the toner restricting portion 41 is advantageous in that the toner T is not only prevented from entering the gap S2 but also positively supplied to the developing roller 35.

Figure 6:
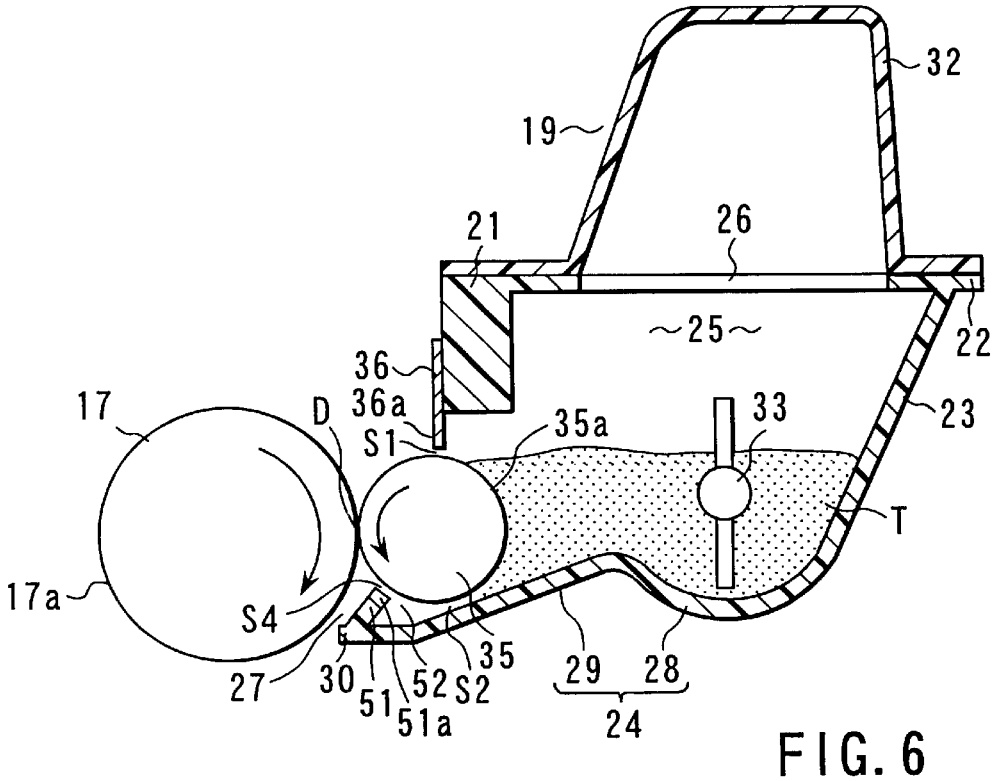
FIG. 6 is a cross-sectional view of a developing apparatus according to a third embodiment of the present invention.

FIG. 6 shows a third embodiment of the present invention.

In the third embodiment, a toner restricting portion 51 is formed integrally with the extension portion 30 at the top end of the inclined portion 29. The toner restricting portion 51, projected upward from the extension portion 30, directly faces the gap S2 at a little distance from the gap S2 to the side of the photosensitive drum 17. The toner restricting portion 51 is inclined at an angle so as to be directed to the center of the developing roller 35 immediately downstream from the gap S2. The height of the toner restricting portion 51 and the relative position thereof with respect to the developing roller 35 and the gap S2 are set so as not to inhibit the toner T remaining on the peripheral surface 35*a* of the developing roller 35 from returning to the gap S2. For this reason, a gap S4, having such a width as to allow passage of the toner T to be returned to the toner storing chamber 25 from the developing roller 35, is formed between the top end 51*a* of the toner restricting portion 51 and the peripheral surface 35*a* of the developing roller 35.

Further, a toner holding portion 52 is formed between the toner restricting portion 51 inclined toward the center of the developing roller 35 and the extension portion 30 of the bottom wall 24. The toner holding portion 52 is a dead-end space, which is located immediately downstream from the gap S2 and tapered toward the end from the gap S2.

With the above structure, since the toner restricting portion 51 closes the gap S2 from the side of the photosensitive drum 17, even if the toner T existing near the gap S2 flows into the gap S2 as the pressure of the toner T in the toner storing chamber 25 is increased, the flow of the toner T is blocked at the position of the toner restricting portion 51.

For this reason, the toner T remaining on the peripheral surface 35*a* of the developing roller 35 and facing the gap S2 or existing near the gap S2 is prevented from pressed out of the toner container 21 through the opening 27. Therefore, in spite of the gap S2 for collecting the toner T formed between the developing roller 35 and the bottom wall 24, the toner T is inhibited from scattering out of the toner container 21, thereby preventing the transfer path 9, the photosensitive drum 17 or the recording paper sheet 5 from contamination.

Further, as the developing roller 35 rotates, the toner T remaining between the gap S2 and the toner restricting portion 51 is attracted to the peripheral surface 35*a* of the developing roller 35 by the magnetic force of the magnet roller and returned to the toner storing chamber 25. Therefore, the toner T does not remain on the extension portion 30 of the bottom wall 24. In this respect also, the toner restricting portion 51 serves to prevent scattering of the toner T.

In addition, since the toner holding portion 52 constituted by the tapered space is formed between the toner restricting portion 51 and the extension portion 30 of the bottom wall 24, the toner T passed through the gap S2 is guided to the space under the toner restricting portion 51 and held in the toner holding portion 52. Therefore, the toner T passed through the gap S2 never flows out beyond the toner restricting portion 51.

Moreover, as the developing roller 35 rotates, the toner T held in the toner holding portion 52 is attracted to the peripheral surface 35*a* of the developing roller 35 and returned to the gap S2, and then returned to the toner storing chamber 25. Therefore, the toner T whose movement is restricted by the toner restricting portion 51 does not flow over the toner restricting portion 51.

Furthermore, the gap S4 is formed between the top end 51*a* of the toner restricting portion 51 and the peripheral surface 35*a* of the developing roller 35 to allow passage of the toner T remaining on the peripheral surface 35*a* of the developing roller 35. Therefore, the remaining toner T is not scraped off by the toner restricting portion 51. The particles of the toner T attracted to the peripheral surface 35*a* of the developing roller 35 are kept standing on the peripheral surface 35*a*, for example, like ears of wheat or a rice plant. Therefore, if there is no gap S4, the toner T will be brought into contact with the toner restricting portion 51, in which case external force applied to the toner T by the contact will exceed the magnetic force holding the toner T to the peripheral surface 35*a* of the developing roller 35. As a result, the toner T may be removed off from the peripheral surface 35*a* and flow out of the toner container 21.

However, according to the present invention, the gap S4 is formed between the developing roller 35 and the toner restricting portion 51. Therefore, even if the toner T remaining on the peripheral surface 35*a* of the developing roller 35 reaches the toner restricting portion 51, the toner T will be returned to the toner storing chamber 25 through the gap S4. In other words, the toner T to be returned to the toner storing chamber 25 does not scatter out of the toner container 21. Consequently, the transfer path 9, the photosensitive drum 17 or the recording paper sheet 5 is prevented from contamination.

Figure 7:
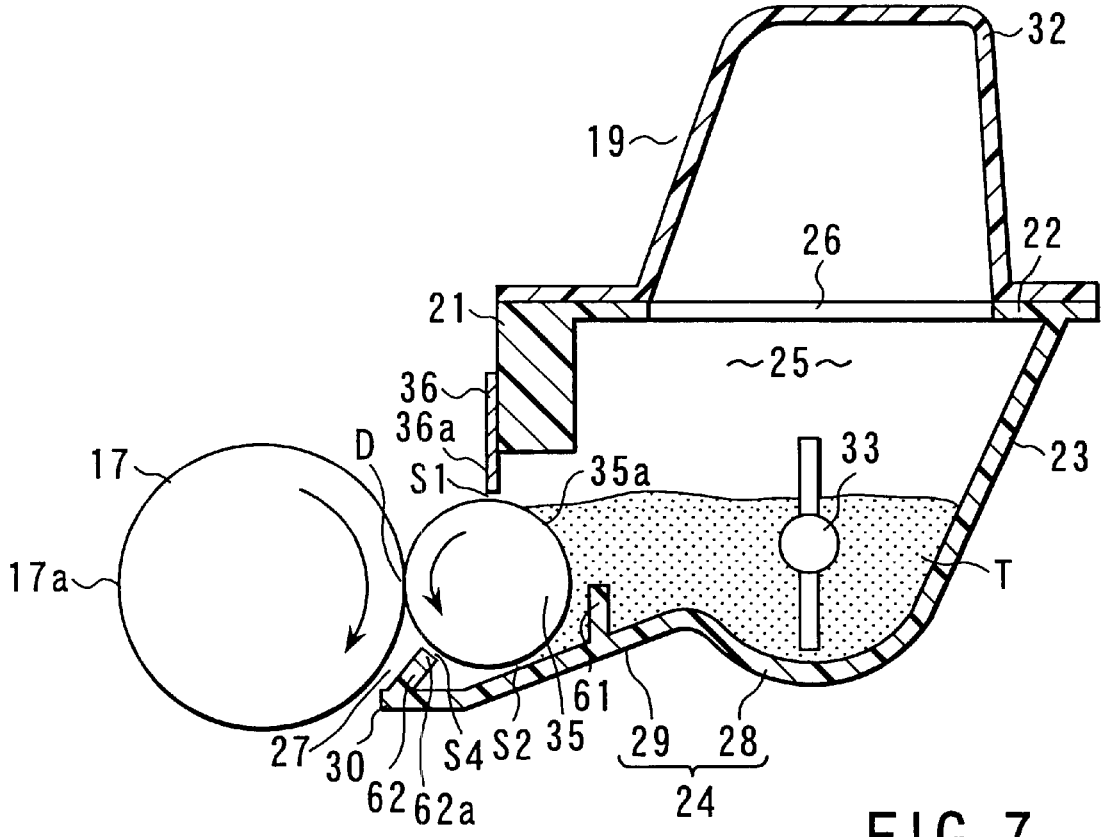
FIG. 7 is a cross-sectional view of a developing apparatus according to a fourth embodiment of the present invention.

FIG. 7 shows a fourth embodiment of the present invention.

The fourth embodiment is the combination of the first and third embodiments. More specifically, the bottom wall 24 of the toner container 21 comprises a first toner restricting portion 61 and a second toner restricting portion 62. The first toner restricting portion 61 is projected upward from the inclined portion 29 at a position a little distance from the developing roller 35 to be inside the toner container 21. The first toner restricting portion 61 directly faces the gap S2 near the peripheral surface 35*a* of the developing roller 35.

The second toner restricting portion 62, projected upward from the extension portion 30, directly faces the gap S2 at a little distance from the gap S2 to the side of the photosensitive drum 17. The second toner restricting portion 62 is inclined at an angle so as to be directed to the center of the developing roller 35. Thus, the first and second toner restricting portions 61 and 62 face each other with the developing roller 35 interposed therebetween.

Further, there is a gap S4 between the top end 62*a* of the second toner restricting portion 62 and the peripheral surface 35*a* of the developing roller 35 to allow passage of the toner T to be returned to the toner container 21 from the developing roller 35.

With the above structure, since the first toner restricting portion 61 inside of the toner container 21 faces the gap S2, it can receive the pressure of the toner T flowing toward the gap S2 and the toner T rushed toward the gap S2 by the increase of the pressure immediately upstream from the gap S2. Moreover, since the second toner restricting portion 62 closes the gap S2 from the side of the photosensitive drum 17, even if the toner T flows into the gap S2, the flow of the toner T is blocked at the position of the second toner restricting portion 62.

For this reason, even if the toner T remaining on the peripheral surface 35*a* of the developing roller 35 and facing the gap S2 or the toner T existing near the gap S2 is liable to be pressed out of the toner container 21 through the gap S2, the movement of the toner T is stopped by the first and second toner restricting portions 61, 62 provided on both sides of the developing roller 35. Therefore, it is particularly ensured that the toner T is prevented from scattering out of the toner container 21.

In the above structure, the height of the first toner restricting portion 61 and the relative position thereof with respect to the developing roller 35 must be set so as not to inhibit supply of the toner T to the developing roller 35. Therefore, it is inevitable that the toner T in the toner container 21 flows into the gap S2. However, since the gap S2 is closed by the second toner restricting portion 62 from the outside, the toner T is prevented from flowing out through the gap S2 even under the conditions that the toner T easily enters the gap S2. Therefore, the structure of the fourth embodiment satisfies the mutually contradictory requirements for smooth supply of the toner T to the developing roller 35 and prevention of scatter of the toner T.

In addition, since the first toner restricting portion 61 restricts the flow of the toner T toward the gap S2 in the inside of the toner container 21, the amount of the toner T that enters the gap S2 can be suppressed. Therefore, in spite of the presence of the gap S4 between the top end 62*a* of the second toner restricting portion 62 and the peripheral surface 35*a* of the developing roller 35, the toner T is prevented from spilling out through the gap S4. Thus, the toner T can be returned efficiently to the toner storing chamber 25 and prevented from scattering out of the toner container 21.

The means for adhering the toner to the peripheral surface of the developing roller of this embodiment is not limited to the magnetic force of the magnet roller incorporated in the developing roller. For example, the peripheral surface of the developing roller may be charged by friction between the developing roller and another roller in contact thereto, so that the toner may be adhered to the peripheral surface of the developing roller by static electricity. Therefore, the toner is not limited to magnetic toner but may be non-magnetic toner.

The toner restricting portion is not necessarily formed integrally with the bottom wall of the toner container. A toner restricting portion independent of the toner container may be fixed to the bottom wall by adhesive or a screw.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A developing apparatus comprising:

a toner container which stores toner, the toner container having a bottom wall which receives the toner and an opening formed at an end portion of the bottom wall and facing a photosensitive body on which an electrostatic latent image is formed;

a toner supplying body located at the opening of the toner container, the toner supplying body having a peripheral surface which is exposed in the toner container and to which the toner is adhered, wherein the toner supplying body supplies the toner adhered to the peripheral surface to the photosensitive body by rotation, and wherein a gap is formed between the peripheral surface of the toner supplying body and the bottom wall of the toner container through which toner remaining on the peripheral surface of the toner supplying body is returned to the toner container; and a toner restricting portion projected upward from the bottom wall of the toner container, the toner restricting portion facing the gap at a position distanced from the toner supplying body so as to be inside the toner container.

2. A developing apparatus according to claim 1, wherein the bottom wall of the toner container has an inclined portion inclined downward toward the opening of the toner container, the inclined portion being located under the toner supplying body, and wherein the restricting portion is projected upward from the inclined portion.

3. A developing apparatus according to claim 2, wherein the toner restricting portion directly faces the gap in proximity to the toner supplying body.

4. A developing apparatus according to claim 3, wherein the toner restricting portion and the toner supplying body are in proximity to each other in a positional relationship which does not inhibit the toner from flowing toward the toner container from the gap.

5. A developing apparatus according to claim 3, wherein the toner restricting portion is inclined toward the peripheral surface of the toner supplying body.

6. A developing apparatus comprising:

a toner container which stores toner, the toner container having a bottom wall which receives the toner and an opening formed at an end portion of the bottom wall and facing a photosensitive body on which an electrostatic latent image is formed;

a toner supplying body located at the opening of the toner container, the toner supplying body having a peripheral surface which is exposed in the toner container and to which the toner is adhered, wherein the toner supplying body supplies the toner adhered to the peripheral surface to the photosensitive body by rotation, and wherein a gap is formed between the peripheral surface of the toner supplying body and the bottom wall of the toner container through which toner remaining on the peripheral surface of the toner supplying body is returned to the toner container; and a toner restricting portion projected upward from the bottom wall of the toner container, the toner restricting portion facing the gap at a position distanced from the gap to a side of the photosensitive body, and the toner restricting portion being inclined toward the peripheral surface of the toner supplying body.

7. A developing apparatus according to claim 6, wherein the toner restricting portion directly faces the gap in proximity to the toner supplying body, and a toner holding portion comprising a dead-end space is formed between the toner restricting portion and the bottom wall.

8. A developing apparatus according to claim 7, wherein the toner restricting portion has a top end facing the peripheral surface of the toner supplying body, and a gap that allows passage of the toner remaining on the peripheral surface of the toner supplying body is formed between the top end of the toner restricting portion and the peripheral surface of the toner supplying body.

9. A developing apparatus comprising:

a toner container for storing toner, the toner container having a bottom wall for receiving the toner and an opening formed at an end portion of the bottom wall and facing a photosensitive body on which an electrostatic latent image is formed;

a toner supplying body located at the opening of the toner container, the toner supplying body having a peripheral surface which is exposed in the toner container and to which the toner is adhered, for supplying the toner adhered to the peripheral surface to the photosensitive body by rotation, a gap being formed between the peripheral surface and the bottom wall to return toner remaining on the peripheral surface of the toner supplying body to the toner container; and first and second toner restricting portions projected upward from the bottom wall of the toner container and facing the gap with the toner supplying body interposed therebetween.

10. A developing apparatus according to claim 9, wherein the first toner restricting portion faces the gap inside the toner container, and the second toner restricting portion faces the gap at a position a distance from the gap to a side of the photosensitive body.

11. An image processing unit comprising:

a photosensitive body on which an electrostatic latent image is formed; and a developing apparatus which develops the electrostatic latent image formed on the photosensitive body, the developing apparatus comprising:

a toner container which stores toner, the toner container having a bottom wall which receives the toner and an opening formed at an end portion of the bottom wall and facing the photosensitive body;

a toner supplying body located at the opening of the toner container, the toner supplying body having a peripheral surface which is exposed in the toner container and to which the toner is adhered, wherein the toner supplying body supplies the toner adhered to the peripheral surface to the photosensitive body by rotation, and wherein a gap is formed between the peripheral surface of the toner supplying body and the bottom wall of the toner container through which toner remaining on the peripheral surface of the toner supplying body is returned to the toner container; and at least one toner restricting portion projected upward from the bottom wall of the toner container, the at least one toner restricting portion facing the gap at one of: (i) a position distanced from the toner supplying body so as to be inside the toner container, and (ii) a position distanced from the gap to a side of the photosensitive body.

12. An electronic photographing apparatus comprising:

an apparatus body having a transfer path through which a sheet-like recording medium is transferred;

a photosensitive body which is arranged in the transfer path and on which an electrostatic latent image is formed; and a developing apparatus which adheres toner to the electrostatic latent image to thereby forming a toner image, the developing apparatus comprising:

a toner container which stores the toner, the toner container having a bottom wall which receives the toner and an opening formed at an end portion of the bottom wall and facing the photosensitive body;

a toner supplying body located at the opening of the toner container, the toner supplying body having a peripheral surface which is exposed in the toner container and to which the toner is adhered, wherein the toner supplying body supplies the toner adhered to the peripheral surface to the photosensitive body by rotation, and wherein a gap is formed between the peripheral surface of the toner supplying body and the bottom wall of the toner container through which toner remaining on the peripheral surface of the toner supplying body is returned to the toner container; and at least one toner restricting portion projected upward from the bottom wall of the toner container, the at least one toner restricting portion facing the gap at one: (i) of a position distanced from the toner supplying body so as to be inside the toner container, and (ii) a position distanced from the gap to a side of the photosensitive body.

13. An electronic photographing apparatus according to claim 12, wherein the toner restricting portion directly faces the gap in proximity to the toner supplying body.

14. A developing apparatus comprising:

a toner container which stores toner, the toner container having a bottom wall which receives the toner and an opening formed at an end portion of the bottom wall and facing a photosensitive body on which an electrostatic latent image is formed;

a toner supplying body located at the opening of the toner container, the toner supplying body having a peripheral surface which is exposed in the toner container and to which the toner is adhered, wherein the toner supplying body supplies the toner adhered to the peripheral surface to the photosensitive body by rotation, and wherein a gap is formed between the peripheral surface of the toner supplying body and the bottom wall of the toner container through which toner remaining on the peripheral surface of the toner supplying body is returned to the toner container; and a toner restricting portion projected upward from the bottom wall of the toner container, the toner restricting portion facing the gap at a position distanced from the toner supplying body so as to be inside the toner container;

wherein the bottom wall of the toner container has an inclined portion inclined downward toward the opening of the toner container, the inclined portion being located under the toner supplying body, and wherein the restricting portion is projected upward from the inclined portion.

15. A developing apparatus according to claim 14, wherein the toner restricting portion is inclined toward the peripheral surface of the toner supplying body.

16. An image processing unit comprising:

a photosensitive body on which an electrostatic latent image is formed; and a developing apparatus which develops the electrostatic latent image formed on the photosensitive body, the developing apparatus comprising:

a toner container which stores toner, the toner container having a bottom wall which receives the toner and an opening formed at an end portion of the bottom wall and facing the photosensitive body;

a toner supplying body located at the opening of the toner container, the toner supplying body having a peripheral surface which is exposed in the toner container and to which the toner is adhered, wherein the toner supplying body supplies the toner adhered to the peripheral surface to the photosensitive body by rotation, and wherein a gap is formed between the peripheral surface of the toner supplying body and the bottom wall of the toner container through which toner remaining on the peripheral surface of the toner supplying body is returned to the toner container; and at least one toner restricting portion projected upward from the bottom wall of the toner container, the at least one toner restricting portion facing the gap at one of: (i) a position distanced from the toner supplying body so as to be inside the toner container, and (ii) a position distanced from the gap to a side of the photosensitive body, and the at least one toner restricting portion being inclined toward the peripheral surface of the toner supplying body.

* * * * *